US009042073B2

(12) United States Patent
Mills et al.

(10) Patent No.: US 9,042,073 B2
(45) Date of Patent: May 26, 2015

(54) ELECTRICAL SWITCHING APPARATUS WITH EMBEDDED ARC FAULT PROTECTION AND SYSTEM EMPLOYING SAME

(75) Inventors: Patrick Wellington Mills, Bradenton, FL (US); James Michael McCormick, Bradenton, FL (US); Richard George Benshoff, Sarasota, FL (US); Steven Christopher Schmalz, Franklin, WI (US)

(73) Assignee: EATON CORPORATION, Cleveland, OH (US)

( * ) Notice: Subject to any disclaimer, the term of this patent is extended or adjusted under 35 U.S.C. 154(b) by 600 days.

(21) Appl. No.: 13/422,305

(22) Filed: Mar. 16, 2012

(65) Prior Publication Data

US 2013/0242450 A1 Sep. 19, 2013

(51) Int. Cl.

| | |
|---|---|
| ***H01H 73/00*** | (2006.01) |
| ***H01H 71/68*** | (2006.01) |
| *H01H 71/58* | (2006.01) |
| *H01H 83/20* | (2006.01) |
| *H01H 71/66* | (2006.01) |

(52) U.S. Cl.

CPC ..... *H01H 71/68* (2013.01); *H01H 71/58* (2013.01); *H01H 83/20* (2013.01); *H01H 2071/665* (2013.01); *H01H 2083/201* (2013.01)

(58) Field of Classification Search

USPC ..... 361/115

See application file for complete search history.

(56) References Cited

U.S. PATENT DOCUMENTS

| | | | | |
|---|---|---|---|---|
| 3,594,668 | A * | 7/1971 | Clarke et al. | 335/13 |
| 3,651,436 | A * | 3/1972 | Cooper et al. | 335/13 |
| 4,502,033 | A * | 2/1985 | Grenier | 337/75 |
| 6,477,022 | B1 * | 11/2002 | Ennis et al. | 361/42 |
| 6,639,942 | B1 | 10/2003 | Bayazit | |
| 6,864,446 | B1 | 3/2005 | Mills | |
| 7,064,636 | B1 * | 6/2006 | Walz et al. | 335/18 |
| 8,094,436 | B2 * | 1/2012 | Mills et al. | 361/636 |
| 2002/0089401 | A1 * | 7/2002 | Arnold et al. | 335/273 |

(Continued)

FOREIGN PATENT DOCUMENTS

| | | | |
|---|---|---|---|
| EP | 1209712 | A1 | 5/2002 |
| WO | 2009/013603 | A2 | 1/2009 |

OTHER PUBLICATIONS

European Patent Office, "Internationai Search Report and Written Opinion" for International Application No. PCT/US2013/029479, Jun. 12, 2013.

*Primary Examiner* — Ronald W Leja

(74) *Attorney, Agent, or Firm* — Eckert Seamans Cherin & Mellot, LLC; Grant E. Coffield

(57) ABSTRACT

An electrical switching apparatus, such as a subminiature circuit breaker, includes a housing assembly, separable contacts, an operating mechanism having an actuator device and a latching assembly, a first trip device for tripping open the separable contacts in response to an overcurrent condition, and a second trip device for tripping open the separable contacts in response to an arc fault, a ground fault or a remotely transmitted signal. The subminiature circuit breaker includes a reset solenoid and a trip solenoid. The resent solenoid is coupled to the actuator device, and includes a coil operable to electrically reset the separable contacts. The trip solenoid is coupled to the latching assembly, and includes a coil operable to move the catch lever, thereby electrically tripping open the separable contacts.

18 Claims, 5 Drawing Sheets

(56) References Cited

U.S. PATENT DOCUMENTS

2006/0132267 A1* 6/2006 Walz et al. ..... 335/35
2007/0121268 A1* 5/2007 Terhorst ..... 361/115
2010/0164744 A1* 7/2010 Parker et al. ..... 340/825.69
2011/0235244 A1* 9/2011 Mills et al. ..... 361/656
2013/0242450 A1* 9/2013 Mills et al. ..... 361/115

* cited by examiner

ELECTRICAL SWITCHING APPARATUS WITH EMBEDDED ARC FAULT PROTECTION AND SYSTEM EMPLOYING SAME

BACKGROUND

1. Field

The disclosed concept relates generally to electrical switching apparatus and, more particularly, to electrical switching apparatus, such as remote control subminiature circuit breakers with embedded arc fault protection. The disclosed concept also relates to systems employing remote control subminiature circuit breakers with embedded arc fault protection.

2. Background Information

Electrical switching apparatus include, for example, circuit switching devices; circuit interrupters, such as circuit breakers; network protectors; contactors; motor starters; motor controllers; and other load controllers.

One use of miniature or subminiature circuit breakers, for example, is in devices or environments with limited space and/or weight limitations, such as, for example and without limitation, aircraft electrical systems, where they not only provide overcurrent protection, but also serve as switches for turning equipment on and off. As such, they are subjected to heavy use and, therefore, must be capable of performing reliably over many operating cycles.

Subminiature circuit breakers have the typical circuit breaker components, such as a non-conductive housing, an external actuator, at least two external terminals structured to be coupled to a line and a load, a pair of separable contacts including a first, stationary contact electrically coupled to one external terminal and a second, movable contact couple to the other external terminal, an operating mechanism structured to move the separable contacts between a first, closed position wherein the contacts engage and electrically connect each other, and a second position wherein the contacts are separated, and a trip device structured to latch the operating mechanism in the first position until an over-current condition occurs. The operating mechanism includes a bias element (e.g., without limitation, spring) biasing the separable contacts toward the second position. Thus, when the trip device is actuated, the latch releases the operating mechanism and the separable contacts move to the second position. The operating mechanism is also coupled to the external actuator. The external actuator is structured to move the separable contacts to the first position after a trip event, or may be used to manually separate the contacts.

Known circuit breakers having arc fault protection include a trip device with at least two tripping mechanisms; one mechanism for an over-current situation and one mechanism for an arc fault on the load side of the circuit breaker. The over-current mechanism typically includes an elongated bimetal element that bends in response to temperature changes. The act of bending actuates the latch, thereby allowing the operating mechanism to separate the separable contacts. Heat is created in response to current passing through the bimetal element. Thus, the greater the amount of current, the greater the degree of bending. The electronic arc fault mechanism of such breakers includes an electronic arc fault detector and a solenoid assembly. When the electronic arc fault detector sensed an arc, a the solenoid sends a pulse and actuates the trip device. Among other disadvantages, such designs were relatively large occupying a significant amount of space.

Additionally, under certain circumstances, it would be may be desirable to provide remote control operation of subminiature circuit breakers.

There is, therefore, room for improvement in electrical switching apparatus, such as subminiature circuit breakers, and in systems employing the same.

SUMMARY

These needs and others are met by embodiments of the disclosed concept, which are directed to a remote control electrical switching apparatus, such as a subminiature circuit breaker, having embedded arc fault protection, and to systems employing the same.

As one aspect of the disclosed concept, an electrical switching apparatus comprises: a housing assembly; separable contacts enclosed by the housing assembly; an operating mechanism for opening and closing the separable contacts, the operating mechanism includes an actuator device and a latching assembly; a first trip device structured to trip open the separable contacts in response to an overcurrent condition; a second trip device structured to trip open the separable contacts in response to an arc fault, a ground fault or a remotely transmitted signal; a first solenoid operatively coupled to the actuator device; and a second solenoid operatively coupled to the latching assembly.

The separable contacts may include a fixed contact and a movable contact, wherein the separable contacts are movable between a first position corresponding to the movable contact and the fixed contact being electrically connected, and a second position corresponding to the movable contact and the fixed contact being spaced apart and not electrically connected. The operating mechanism may further include a biasing element, wherein the biasing element biases the separable contacts toward the second position. The latching assembly may include a catch lever and a mechanical linkage, the biasing element may be a spring, and the actuator device may be a reset button, wherein the reset button is structured to compress the spring and reset the catch lever of the latching assembly.

The first trip device may include a bi-metallic element, wherein the mechanical linkage cooperates with the catch lever and the bi-metallic element and wherein, in response to the overcurrent condition, the bi-metallic element heats up causing the bi-metallic element to bend, thereby moving the mechanical linkage and the catch lever to release the spring and trip open the separable contacts. The first solenoid may be a reset solenoid, wherein the reset solenoid includes a coil, and wherein the coil is operable to electrically reset the separable contacts. The second solenoid may be a trip solenoid, wherein the trip solenoid includes a coil, and wherein the coil of the trip solenoid is operable to move the catch lever, thereby electrically tripping open the separable contacts.

In accordance with another aspect of the disclosed concept a system comprises: a mechanism control module; an arc fault detection module; a communications interface; a power supply; a controller; and an electrical switching apparatus comprising: a housing assembly; separable contacts enclosed by the housing assembly; an operating mechanism for opening and closing the separable contacts, the operating mechanism including an actuator device and a latching assembly; a first trip device structured to trip open the separable contacts in response to an overcurrent condition; a second trip device structured to trip open the separable contacts in response to an arc fault, a ground fault or a remotely transmitted signal; a first solenoid operatively coupled to the actuator device; and a second solenoid operatively coupled to the latching assembly.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
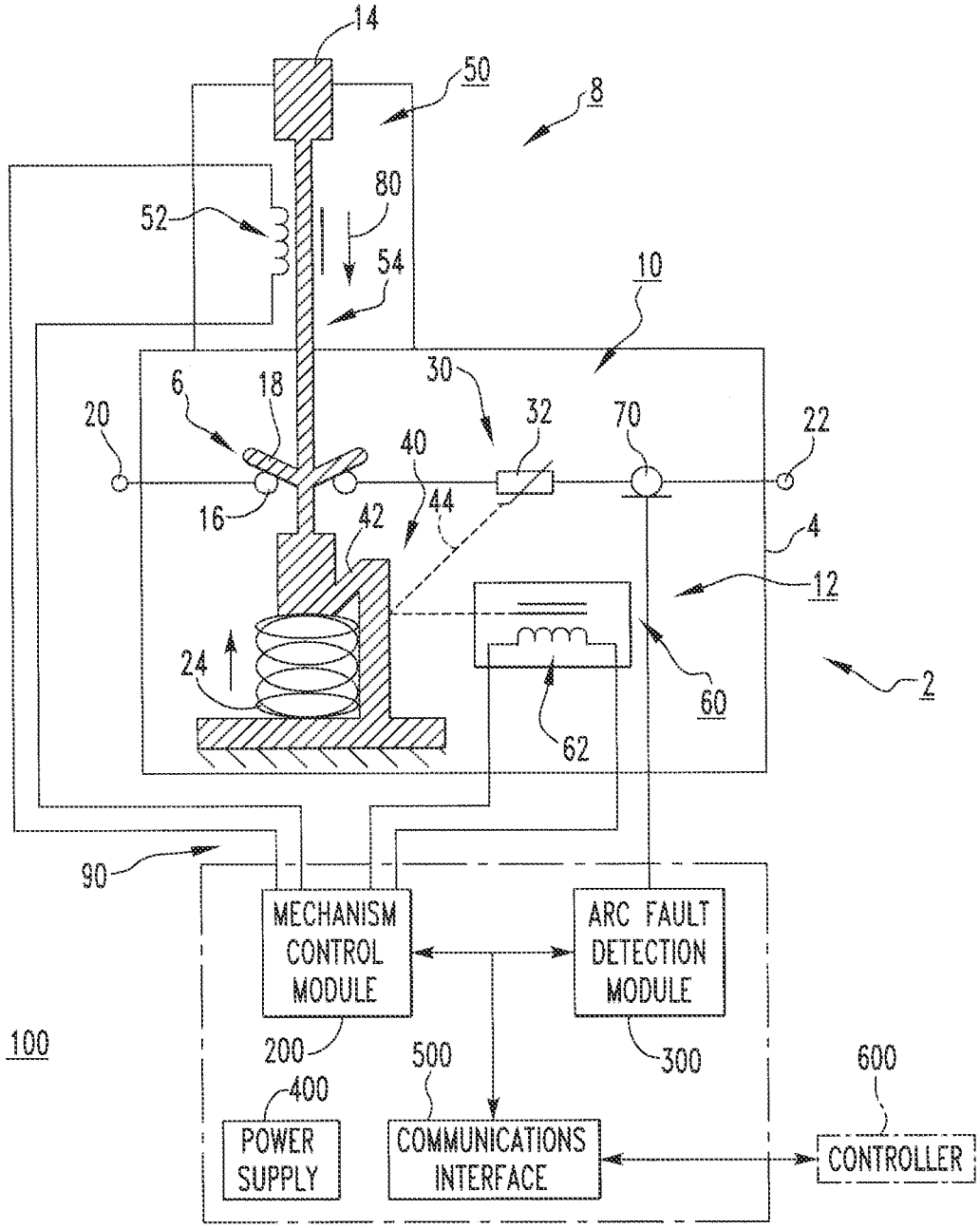
FIG. 1 is a simplified view of a system employing a remote control subminiature circuit breaker having embedded arc fault protection, in accordance with an embodiment of the disclosed concept.

The disclosed concept is described in association with remote control subminiature aircraft circuit breakers, although the disclosed concept is applicable to a wide range of electrical switching apparatus.

Directional phrases used herein, such as, for example, left, right, front, back, top, bottom and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a simplified view of a system 100, employing an electrical switching apparatus such as, for example and without limitation, a remote control subminiature aircraft circuit breaker 2, in accordance with an embodiment of the disclosed concept.

The circuit breaker 2 includes a housing assembly 4, made from a non-conductive material such as, for example and without limitation, plastic, a pair of separable contacts 6, an operating mechanism 8, and a number of trip devices 10,12. An actuator device (e.g., without limitation, reset button 14) is movably coupled to the housing assembly and structured to travel in the vertical direction to actuate (e.g., reset) the separable contacts. The separable contacts 6 include a first, fixed contact 16, and a second, movable contact 18. Both the first and second contact 16,18 each are coupled to, or are integral with, a corresponding terminal 20,22, respectively, that extends outside said housing 4. The external terminals 20,22 are structured to be coupled to either a line or a load.

Figure 6:
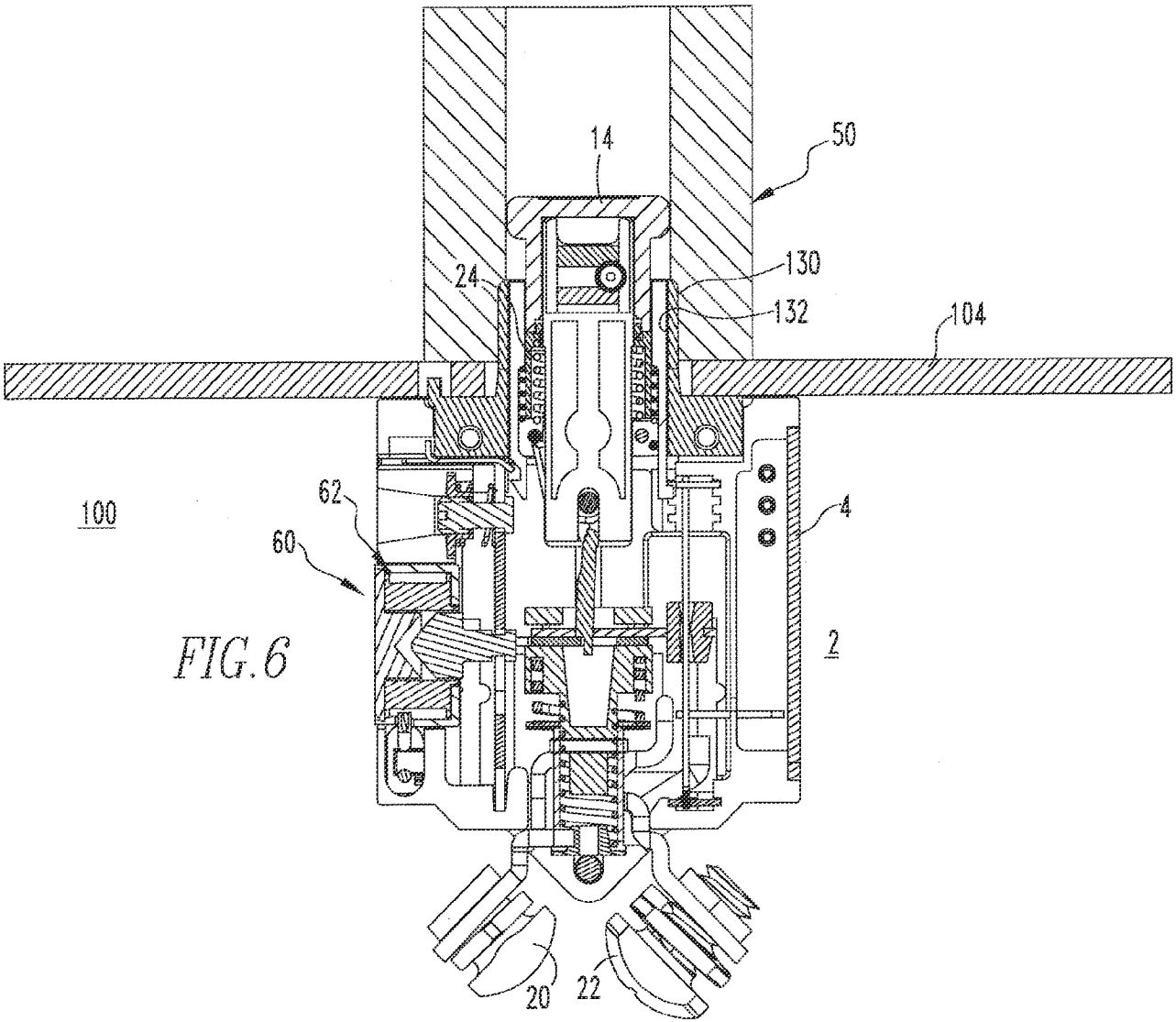
FIG. 6 is a section view taken along line 6-6 of FIG. 5.

The operating mechanism 8 is coupled to, and structured to move, the separable contacts 6 between a first, closed position (FIG. 1), wherein the movable contact 18 engages and is electrically connected to the fixed contact 16, and a second, open position (FIG. 6), wherein the movable contact 18 is spaced from the fixed contact 16. The operating mechanism 8 includes a biasing element (e.g., without limitation, spring 24) that is structured to bias the separable contacts 6 to the second, open position. As will be described in greater detail hereinbelow, the example subminiature circuit breaker 2 preferably includes a first trip device 10 comprising a thermo-mechanical mechanism 30, for providing standard overcurrent protection, as well as a second trip device 12 for providing embedded arc fault protection.

The thermo-mechanical mechanism 30 includes a bi-metallic element 32. Load circuit current is passed through a bi-metallic element 32 causing it to heat up proportional to $I^2t$, which correlates to the power dissipated in the power distribution wires. The bi-metallic element 32 is designed such that its bending displacement is closely proportional to its temperature, and is mechanically coupled to a spring-loaded latching assembly 40 in the circuit breaker 2. The latching assembly 40 includes a catch lever 42, which is structured to hold the separable contacts 6 closed. In operation, at a predetermined temperature, the bi-metallic element 32 displaces the catch lever 42 via a mechanical linkage 44 (shown in simplified form as a broken line, in FIG. 1) an adequate distance to trip the latching assembly 40, thereby releasing the compression on the spring 24 to drive the separable contacts 6 to open and interrupt the load circuit current. It will be appreciated that any known or suitable alternative number, type and/or configuration of thermo-mechanical mechanism (not shown) could be employed without departing from the scope of the disclosed concept. For example and without limitation, it will be appreciated that a second bi-metallic element (not shown) through which the load current is not passed, could be employed to provide ambient temperature compensation with a suitable mechanical linkage.

The subminiature circuit breaker 2 can be reset by moving the reset button 14, which is coupled to the separable contacts 6. That is, depressing the reset button 14 (e.g., without limitation, downward in the direction of arrow 80, from the perspective of FIG. 1) functions to re-compress the spring 24 and re-engage the catch lever 42 of the latching assembly 40. The disclosed remote control subminiature circuit breaker 2 includes a first solenoid 50 (also shown in FIGS. 2-6) and a second solenoid 60. The first solenoid 50 is coupled to the separable contacts 6 (FIG. 1), and comprises a coil 52 and a magnetic plunger 54. The second solenoid 60 also includes a coil 62, which cooperates with the latching assembly 40.

EXAMPLE

Figure 2:
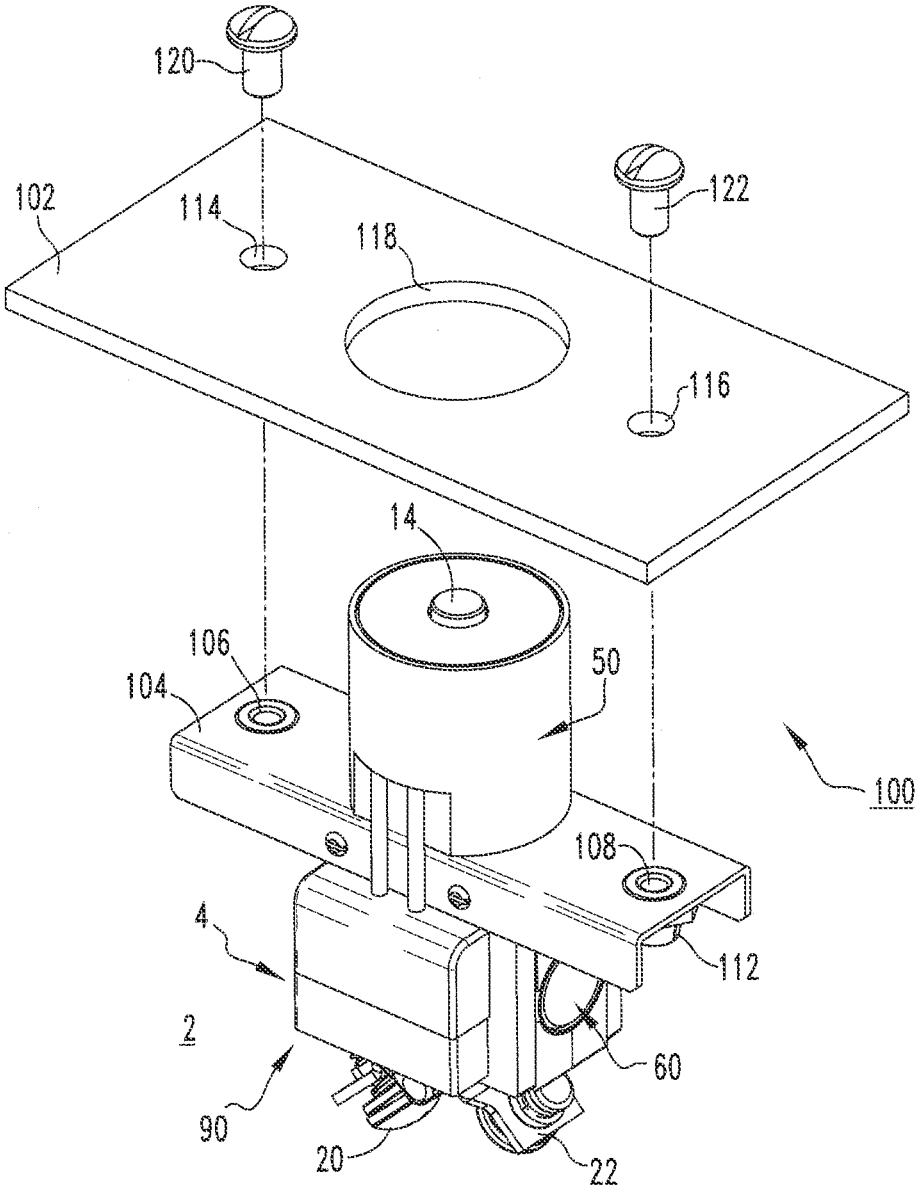
FIG. 2 is a partially exploded top isometric view of the subminiature circuit breaker of FIG. 1.
Figure 3:
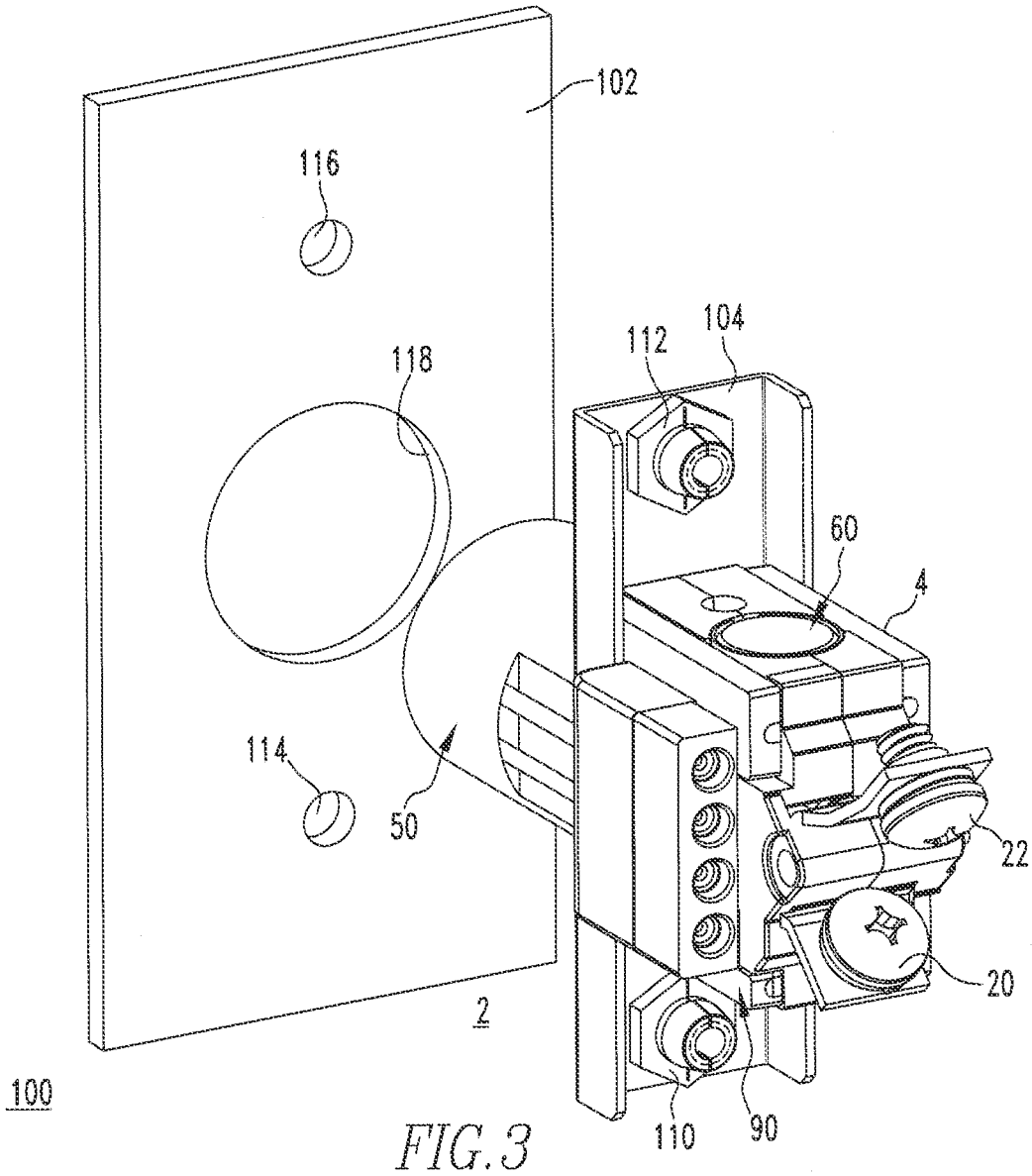
FIG. 3 is a partially exploded back isometric view of the subminiature circuit breaker of FIG. 2.
Figure 5:
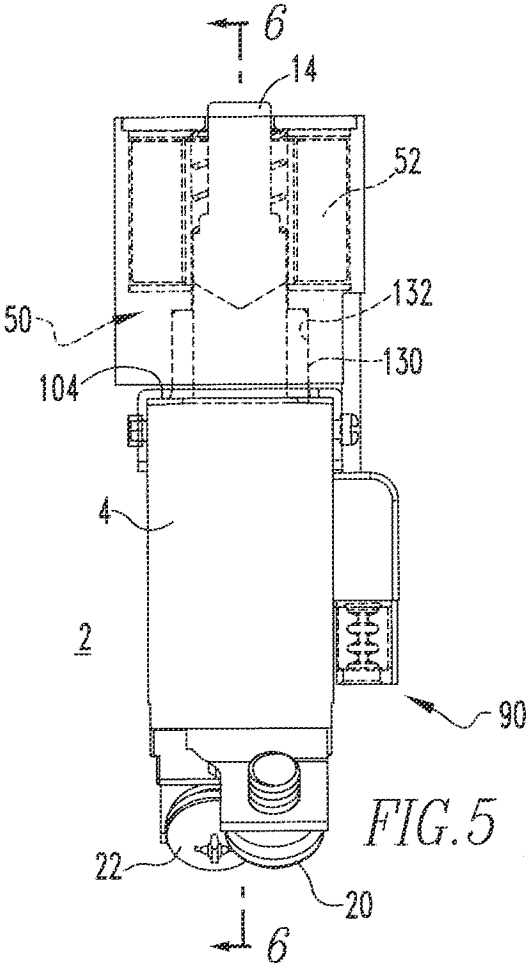
FIG. 5 is an end elevation view of the subminiature circuit breaker of FIG. 4, partially shown in section view.
Figure 4:
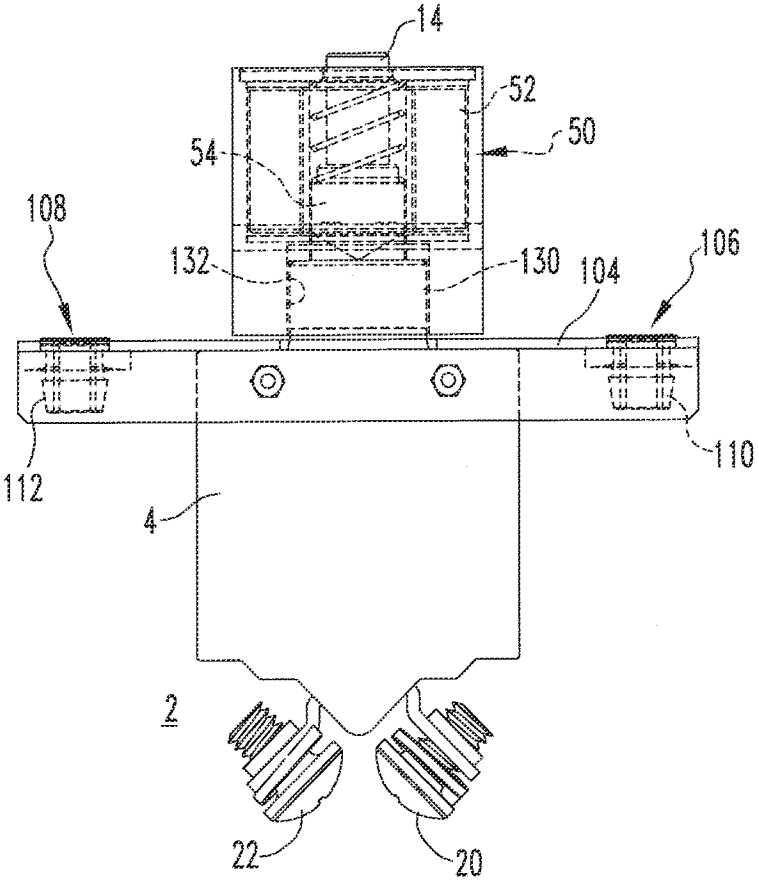
FIG. 4 is an assembled side elevation view of the subminiature circuit breaker of FIG. 3, partially shown in section view.

In the non-limiting example shown in FIG. 1, the subminiature circuit breaker 2 includes a connector or receptacle 90 (indicated generally by reference 90 in FIG. 1; see also FIGS. 2, 3 and 5). Specifically, the connector or receptacle 90 provides for quick and convenient electrical connection, for example, to an electronic Mechanism Control Module (MCM) 200 (shown in simplified form in FIG. 1) of the system 100.

The first solenoid 50 is energized via the MCM 200, and is structured to electrically reset the circuit breaker 2 (i.e., contact closure). The second solenoid 60 is mechanically coupled to the latching assembly 40 in a similar manner as the bi-metallic element 32, previously discussed hereinabove. The second solenoid 60 is also controlled by the MCM 200, and functions to trip the latching assembly 40 when circuit current interruption is desired. Such interruption may, for example and without limitation, be in response to the detection of an arcing fault, a ground fault, or it may be in response to a remotely transmitted signal for control of electrical power to the load.

A current sensor 70 is employed to directly monitor the load circuit current, as shown in FIG. 1. This current sensor 70 may, for example and without limitation, be comprised of a resistive shunt (e.g., without limitation, the bi-metal element 32 itself), a current transformer, a Hall-effect element, or any other known or suitable magneto-resistive element. The signal output by the current sensor 70 is processed by an electronic Arc Fault Detection Module (AFDM) 300 to identify characteristics in the load circuit current indicative of an arc, and to recognize if such a fault condition exists. The AFDM 300 implements any known or suitable combination of detection algorithms, and can be comprised of any known or suitable electronic circuitry including, for example and without limitation, analog devices, discrete logic, programmable logic devices (PLD), field-programmable gate arrays (FPGA), or microprocessor-based circuitry. It will also be appreciated that the AFDM 300 could alternatively be replaced or supplemented by a module with appropriate circuitry (not shown) to implement ground fault detection as well.

As previously discussed, the primary purpose of the MCM 200 is to coordinate energizing of the first and second solenoids 50,60 to trip (i.e. open) or reset (i.e. close) the circuit breaker 2. In performing this coordination, the MCM 200 may retain knowledge on the closed versus open state of the circuit breaker 2 based on memory of previous commanded operations. Since manual reset using the reset button 14 is possible, independent of control from the MCM 200, memory alone may not be sufficient to know breaker contact state. It will, therefore, be appreciated that additional diagnostics may be used employing additional sensors (not shown). For example and without limitation, voltage sensors (not shown) may be used in conjunction with the current sensor 70 by the MCM 200 to determine the state of the circuit breaker separable contacts 6, thereby providing additional information for logical control of the solenoids 50,60. By way of example, without limitation, if such sensors identify the presence of voltage on the line and load terminals 20,22, this would indicate that the separable contacts 6 are closed and the latching assembly 40 is in the latched position. Similarly, if unequal voltages are detected on the terminals 20,22, the separable contacts 6 are in the open state. Non-zero current flow through the load terminal 22 of the circuit breaker 2 may also be used as an indication that the circuit breaker 2 is closed. It will be appreciated that further diagnostics of breaker status may also be employed. For example and without limitation, the MCM 200 could utilize a pair of auxiliary contacts (not shown) mechanically linked to the main circuit breaker contacts 6, as a method to determine the state of the circuit breaker 2.

The solenoids 50,60 are energized by a power supply 400 (shown in simplified form in FIG. 1). More specifically, the solenoids 50,60 can be designed to be energized with either AC or DC power, depending upon availability and appropriateness for a given installation. Accordingly, the MCM 200 employs suitable switching components to apply voltage to the coils 52,62 of solenoids 50,60, respectively. This may be implemented via semiconductor switches (e.g., without limitation, transistors, Silicon Controlled Rectifiers (SCR), Triacs, etc.) or small signal electromechanical relays, although the former would be preferred to minimize size. As with the AFDM 300, the MCM 200 may be comprised of electronic circuitry such as, for example and without limitation, analog devices, discrete logic, programmable logic devices (PLD), field-programmable gate arrays (FPGA), or microprocessor-based circuitry.

A Communications Interface (CI) circuit 500 (shown in simplified form in FIG. 1) monitors status of both the MCM 200 and AFDM 300 and communicates selected information to a controller 600 (e.g., without limitation, remote controller 600, shown in simplified form in FIG. 1) and/or monitoring system. It will, of course, be appreciated that the system 100 could vary in complexity depending on required functionality, without departing from the scope of the disclosed concept. For example and without limitation, the CI (e.g., 500) could be configured to communicate with an ICU circuit breaker (not shown) such that operation is identical to that implemented with generally well known conventional MIL-83383 Remote Controlled Circuit Breakers (RCCB)(not shown). The CI could alternatively comprise circuitry to implement bi-directional communications on fieldbus networks such as, for example and without limitation, any known or suitable ARINC protocols, CAN, RS-485, TTP, or FlexRay to communicate with a local or remotely located Power Distribution Unit (PDU) controller or a master control unit for the corresponding vehicle (e.g., without limitation, aircraft (not shown)) via a network.

In addition to communicating the status of the circuit breaker 2, the CI 500 also receives open and close commands from the controller 600 and passes them on to the MCM 200 to facilitate remote operation. The CI 500 may be comprised of electronic circuitry such as, for example and without limitation, analog devices, discrete logic, programmable logic devices (PLD), field-programmable gate arrays (FPGA), or microprocessor-based circuitry.

By monitoring the breaker open/close status from the MCM 200 in combination with fault indications from the AFDM 300, the cause of a breaker trip can be deduced either in the internal processor, or external to the breaker in the PDU or master controller 600. For example and without limitation, if the MCM 200 detects a breaker trip that is non-coincident with an arc or ground fault having been detected by the AFDM 300 or Ground Fault Detection Module (GFDM)(not shown) or an open command from the controller 600, the trip must be the result of the thermal trip mechanism (e.g., thermo-mechanical mechanism 30) responding to an overcurrent fault. This condition status can be transmitted to the controller 600 via the CI 500.

The power supply 400 is employed to power the MCM 200, AFDM 300, and CI 500 electronic circuitry. By way of example, without limitation, the power may be derived off the input line voltage with respect to vehicle chassis ground (not shown), parasitically off the current flowing through the circuit breaker 2, or from an energy storage element (e.g., without limitation, batteries (not shown); capacitors (not shown)). The power supply 400 also provides voltage transient protection to the electronics in case of source power surges (e.g., without limitation, lightning strikes).

It will be appreciated that it is within the scope of the disclosed concept to integrate the functions of the MCM 200, AFDM 300, and CI 500 into a single electronics assembly with shared central processing elements (e.g., without limitation, microcontroller). Among other benefits, with would serve to leverage advantages in cost, size, and weight.

As best shown in FIGS. 2 and 3, in addition to the foregoing advantages, the disclosed subminiature circuit breaker 2 is also preferably designed to serve as an improved direct replacement or substitute for known electrical switching apparatus. That is, the circuit breaker 2 not only incorporates all of the aforementioned features and advantages, but is also advantageously relatively smaller in size than conventional remote control circuit breakers (not shown) and includes a unique mounting capability that permits it to be readily employed within both new and existing panels (see, for example and without limitation, aircraft panel 102 partially shown in FIGS. 2 and 3).

In the non-limiting example of FIGS. 2 and 3, the circuit breaker 2 includes a mounting bracket 104 having first and second apertures 106,108. First and and second lock nuts 110,112 are disposed at or about the first and second apertures 106,108, respectively. The aircraft panel 102 includes holes 114,116 respectively corresponding to apertures 106,108 and structured to receive fasteners 120,122 (FIG. 2). Thus, the fasteners 120,122 respectively extend through holes 114,116 into apertures 106,108 to threadingly engage lock nuts 110, 112, in order to secure the circuit breaker 2 to the panel 102. The first solenoid 50 extends through a corresponding opening 118 in the panel 102.

It will, therefore, be appreciated that the threaded portion 130 (partially shown in hidden line drawing in FIGS. 4-6) of the circuit breaker 2 to which a mounting nut (not shown) is typically secured, can instead be used to cooperate with corresponding threads 132 (partially shown in hidden line drawing in FIGS. 4-6) of the reset solenoid 50, for example and without limitation, to secure the reset solenoid 50 to the circuit breaker housing 4 and/or panel 102. It will further be appreciated that the circuit breaker 2 could have any known or suitable alternative mounting configuration, without departing from the scope of the disclosed concept. For example and without limitation, the circuit breaker 2 is not required to employ a mounting bracket 104, as shown. The circuit breaker 2 could be secured by way of the aforementioned threaded engagement between the circuit breaker threaded portion 130 and the solenoid 50, by itself, and/or in combination with a mounting nut (not shown).

Accordingly, it will be appreciated that the disclosed remote controlled subminiature circuit breaker 2 provides size, weight and manufacturing cost improvements over known remote control circuit breaker designs. Among other benefits, the circuit breaker 2 can trip/open upon thermal overload and be reset manually, can be remotely opened or closed without the presence of a thermal or AFCI fault, can detect and trip/open if a thermal or arcing even is sensed, can be manually reset or remotely (i.e., electrically) reset, and can indicate if the fault was thermal or an arcing event.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:
a housing assembly including a connection device;
separable contacts enclosed by the housing assembly;
an operating mechanism for opening and closing said separable contacts, said operating mechanism including a reset button and a latching assembly;
a first trip device structured to trip open said separable contacts in response to an overcurrent condition;
a second trip device structured to trip open said separable contacts in response to an arc fault, a ground fault or a remotely transmitted signal;
a reset solenoid operatively coupled to said reset button; and
a trip solenoid operatively coupled to said latching assembly,
wherein said electrical switching apparatus is a remote control subminiature circuit breaker, and
wherein said connection device is structured to electrically connect said remote control subminiature circuit breaker to a power supply.

2. The electrical switching apparatus of claim 1 wherein said separable contacts include a fixed contact and a movable contact; wherein said separable contacts are movable between a first position corresponding to said movable contact and said fixed contact being electrically connected, and a second position corresponding to said movable contact and said fixed contact being spaced apart and not electrically connected;
wherein said operating mechanism further includes a biasing element; and wherein said biasing element biases said separable contacts toward the second position.

3. The electrical switching apparatus of claim 2 wherein said latching assembly includes a catch lever and a mechanical linkage; wherein said biasing element is a spring; and wherein said reset button is structured to compress said spring and reset said catch lever of said latching assembly.

4. The electrical switching apparatus of claim 3 wherein said first trip device includes a bi-metallic element; wherein said mechanical linkage cooperates with said catch lever and said bi-metallic element; and wherein, in response to said overcurrent condition, said bi-metallic element heats up causing said bi-metallic element to bend, thereby moving said mechanical linkage and said catch lever to release said spring and trip open said separable contacts.

5. The electrical switching apparatus of claim 3 wherein said reset solenoid includes a coil; and wherein said coil is operable to electrically reset said separable contacts.

6. The electrical switching apparatus of claim 3 wherein said trip solenoid includes a coil; and wherein said coil of said trip solenoid is operable to move said catch lever, thereby electrically tripping open said separable contacts.

7. The electrical switching apparatus of claim 1 wherein said connection device is a receptacle structured to provide plug-in connectivity.

8. The electrical switching apparatus of claim 1 wherein said second trip device includes at least one sensor; and wherein said at least one sensor is adapted to determine the state of said separable contacts.

9. The electrical switching apparatus of claim 1 wherein said housing assembly includes a threaded portion; wherein said first solenoid includes a plurality of threads; and wherein said threads of said first solenoid threadingly engage said threaded portion of said housing assembly.

10. A system comprising:
a mechanism control module;
an arc fault detection module;
a communications interface;
a power supply;
a controller; and
an electrical switching apparatus comprising:
a housing assembly including a connection device;
separable contacts enclosed by the housing assembly;
an operating mechanism for opening and closing said separable contacts, said operating mechanism including a reset button and a latching assembly;
a first trip device structured to trip open said separable contacts in response to an overcurrent condition;

a second trip device structured to trip open said separable contacts in response to an arc fault, a ground fault or a remotely transmitted signal;

a reset solenoid operatively coupled to said reset button; and a trip solenoid operatively coupled to said latching assembly, wherein said electrical switching apparatus is a remote control subminiature circuit breaker, and wherein said connection device provides plug-in connectivity to electrically connect said remote control subminiature circuit break; to said mechanism control module, said arc fault detection module, said power supply and said communications interface.

11. The system of claim 10 wherein said separable contacts include a fixed contact and a movable contact; wherein said separable contacts are movable between a first position corresponding to said movable contact and said fixed contact being electrically connected, and a second position corresponding to said movable contact and said fixed contact being spaced apart and not electrically connected; wherein said latching assembly includes a catch lever and a mechanical linkage; wherein said operating mechanism further includes a spring; wherein said spring biases said separable contacts toward the second position; and wherein said reset button is structured to compress said spring and reset said catch lever of said latching assembly.

12. The system of claim 11 wherein said first trip device includes a bi-metallic element; wherein said mechanical linkage cooperates with said catch lever and said bi-metallic element; and wherein, in response to said overcurrent condition, said bi-metallic element heats up causing said bi-metallic element to bend, thereby moving said mechanical linkage and said catch lever to release said spring and trip open said separable contacts.

13. The system of claim 11 wherein said reset solenoid includes a coil; wherein said coil is operable to electrically reset said separable contacts; wherein said coil of said trip solenoid is operable to move said catch lever, thereby electrically tripping open said separable contacts; and wherein said reset solenoid and said trip solenoid are energized by said mechanism control module.

14. The system of claim 10 wherein said second trip device includes at least one sensor; wherein said at least one sensor is adapted to provide a signal output; and wherein said signal output is processed by said arc fault detection module.

15. The system of claim 10 whereon said housing assembly includes a threaded portion; wherein said first solenoid includes a plurality of threads; and wherein said threads of said first solenoid threadingly engage said threaded portion of said housing assembly.

16. The system of claim 10 wherein said power supply powers said mechanism control module, said arc fault detection module and said communications interface.

17. The system of claim 10 wherein said communications interface is adapted to monitor the status of said mechanism control module and said arc fault detection module and to communicate selected information to said controller.

18. The system of claim 17 wherein said communication interface is further adapted to receive open and close commands from said controller and communicate said open and close commands to said mechanism control module to facilitate remote operation.

* * * * *